United States Patent [19]

McClain et al.

[11] 4,210,417

[45] Jul. 1, 1980

[54] METHOD OF SOIL RELEASE POLYMER APPLICATION TO FABRICS IN HOME LAUNDERING

[75] Inventors: Charles P. McClain; Jerry E. Yowell, both of La Mirada, Calif.

[73] Assignee: Purex Corporation, Lakewood, Calif.

[21] Appl. No.: 877,273

[22] Filed: Feb. 13, 1978

Related U.S. Application Data

[63] Continuation of Ser. No. 621,667, Oct. 14, 1975, abandoned, which is a continuation-in-part of Ser. No. 519,750, Oct. 31, 1974, abandoned.

[51] Int. Cl.[2] ..... D06M 13/20; B08B 3/00

[52] U.S. Cl. ..... 8/137; 8/115.6; 252/8.6; 252/8.8; 260/29.6 N

[58] Field of Search ..... 8/115.6, 137; 252/8.6, 252/8.8; 260/29.6 N

[56] References Cited

U.S. PATENT DOCUMENTS

| | | | |
|---|---|---|---|
| 3,821,147 | 6/1974 | Dickson | 260/29.6 |
| 3,836,496 | 9/1974 | Dickson | 260/29.6 |
| 3,981,807 | 9/1976 | Raynolds | 252/8.8 |
| 3,985,923 | 10/1976 | Basadur | 260/29.2 E |

*Primary Examiner*—A. Lionel Clingman

*Attorney, Agent, or Firm*—William W. Haefliger

[57] ABSTRACT

Method of home laundering to impart soil release properties to dried laundered fabrics in which a soil release agent having the empirical formula $(C_{39}H_{79}N_2O_{17})_{3n}$ is dispersed in agitated wash or rinse water at dilute concentrations in the range of about 0.0002 to 0.2 weight percent of the water and the fabrics are dried at normal drying temperatures.

6 Claims, No Drawings

METHOD OF SOIL RELEASE POLYMER APPLICATION TO FABRICS IN HOME LAUNDERING

This is a continuation of application Ser. No. 621,667 abandoned, filed Oct. 14, 1975, which was a continuation-in-part of Ser. No. 519,750, filed Oct. 31, 1974 and abandoned.

BACKGROUND OF THE INVENTION

Agents producing soil release and soil repellent finishes have been known for some time and heretofore have been used on an industrial basis in the manufacturing and finishing of fabrics in textile mills. These agents are usually applied to fabrics at high concentrations requiring special equipment and usually requiring chemical and/or heat treatment to produce a durable, efficacious finish.

Such at-the-mill application of soil release agents concentrated in coatings on the fabrics is to be distinguished from the present method wherein the soil release polymer is dispersed in dilute concentration in water used for home laundering in either or both the wash and rinse cycles of conventional washing machines.

SUMMARY OF THE INVENTION

The invention has for its general object to apply the hereinafter designated soil-release polymer to desired fabrics during home laundering, the process being particularly characterized as involving only low water dispersed concentrations of the soil release polymer to produce an efficacious finish on the fabrics without requirement for special equipment, special laundering or drying procedures, or extra laundering time. The process may be used with various combinations of fabrics.

In accordance with the invention, the fabric finish is applied by agitating the fabrics in the wash or rinse cycles of ordinary laundry machines in the presence of what hereinafter will be referred to as the "release polymer" having the empirical formula $(C_{39}H_{79}N_2O_{17})_{3n}$, or pre-diluted versions thereof, available from the du Pont Company under its designation TLF-3755. Pre-diluted versions thereof are available as TLF-3701, TLF-3790, or TLF-3791. The value of n in the formula $(C_{39}H_{79}N_2O_{17})_{3n}$ ranges from about 3 to 10 with a usual average of 3.3 to 4.

Concerning the chemical composition of soil release polymer TLF-3755, it is not made by what may be termed "chemical synthesis" and therefore cannot be precisely described or readily named. Accordingly, at this state of our knowledge, the best identification of the product is in terms of the processes by which it is prepared. The soil release polymer TLF-3755 is made by a telomerization reaction which is believed to be a combined polymerization and addition reaction which derives its name from the fact that the additive groups enter the polymer at positions usually separated by a number of polymer atoms or groups. The reactants consist of substances which add into or onto the polymer structure.

Identifying of necessity the soil release polymer in terms of its method of production, the invention is more specifically described as the method of home laundering fabrics consisting of polyester, polyamide, rayon of modacrylic fibers and blends of these fibers with other natural or synthetic fibers, to impart soil release finishes thereto that comprises the following steps and conditions: agitating the fabrics in an aqueous dispersion of a soil release final polymer product at a polymer concentration of about 0.0002 to 0.2 weight percent of the water. This final polymer product is prepared by loading into a cleaned and dried reactor, 209 parts of a mixture comprising 18% ethylene glycol and 82% of

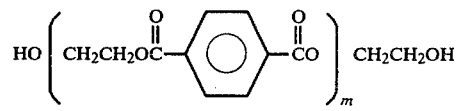

where m is equal to 1, 2, and 3, (i.e. from 1 to 3) to obtain an oligomer mixture with a melting point between 160° and 185° C. Then 1298 parts of monomethyl ether of polyethylene glycol of molecular weight about 550 and about 789 parts of a product prepared by ethoxylation of a mixture of straight-chained alcohols containing 60% dodecanol, 25% tetradecanol, and 11% hexadecanol are added. The resulting product contains about 15 links of ethylene oxide for every mole of alcohol. The mixture is heated to 210°±2° C. and is kept at that temperature for ½ hour and then it is cooled and held at 135°±5° C. Then to the mixture load is added 357 parts of hexa(methoxymethyl) melamine. The mixture is brought under a reduced pressure of 20 to 40 torr for ½ hour. After having introduced gaseous nitrogen to take the pressure of the reactor to one atmosphere, 3.17 parts of anhydrous p-toluene sulfonic acid are added, and the pressure is reduced to 200 torr. When the reaction has started, the pressure in the reactor is reduced between 20 and 40 torr and the load is heated to 190°±2° C. and kept at this temperature for 4 hours to teminate the reaction. The load is cooled to about 70° C. and the pressure in the reactor brought to atmospheric pressure by adding nitrogen. During this time, into a second reactor is loaded 9972 parts of water and 1.7 parts of sodium bicarbonate. The reaction load which has undergone reaction is added to the aqueous bicarbonate solution. The content of solid materials by this neutralization procedure is about 20%. The resulting said polymer product has an empirical formula of $(C_{39}H_{79}N_2O_{17})_{3n}$ wherein n has a value from about 3 to 10, and is suitable for treatment of textiles to improve their antistaining properties.

Based on the empirical formula of the assumed 100% active composition, the use concentration in the wash or rinse water ranges from about 0.0002% to 0.2% by weight of the water with a preferred concentration of from about 0.001% to 0.01%.

Tests indicate that the effectiveness of the release polymer in such concentrations is not consequentially affected by the presence in the wash cycle of such washing aids as water softeners, detergents, or the like, or when added to the rinse cycle in conjunction with conventional water softeners, fabric softeners and the like. The release polymer may be premixed with a water softener and introduced to the wash or rinse cycle; or it may be incorporated into a detergent or presoak and added to the wash cycle; or the polymer may be incorporated in liquid or dry bleaches and added to the wash cycle. The polymer is usable with bluing or whitener-brightener products and added to the wash or rinse cycle; it may be incorporated in starches or similar fabric finishes added to the rinse cycle; or the polymer may be used with fabric softeners added to the rinse cycle or added prior to or during the drying of the fabrics. Finally, the release polymer is and remains effective on the fabrics following drying at temperatures customarily employed in home laundering.

The invention is applicable to the laundering of various fabrics and fiber blends including acetate, acrylic cotton blends, polyamide, polyamide/spandex blend, triacetate, polyester, polyester/cotton blend, and modacrylic. The soil release polymer proved effective on the following: polyamide, polyamide/spandex blend, polyester, polyester/cotton blend, rayon and modacrylic.

While the theory of effective deposition of the dispersed release polymer on the fabrics is not fully understood, it may be hypothecated that the effectiveness may be due in varying respects to the synthetic composition of modern fabrics together with electrostatic attraction of the finely dispersed particles to the fabric surfaces. However, the soil release efficacy of the polymer in resulting from the dilute dispersions contemplated herein for home laundering have been unpredictable on any basis of comparison with the conventional practices of padding-on soil release agents to the fabric at production mills.

We have demonstrated the efficacy of our process by using the test procedure given below. Unless otherwise specified, the detergent used in the following tests is a commercially available laundry detergent (Tide) at 0.15% concentration. If no rinse agent is specified, water only was used in the rinse cycle. The fabric used was white 100% polyester double knit. The control solutions used in the following examples have the same composition as the respective materials except that they contain no soil release polymer which in all instances is $(C_{39}H_{79}N_2O_{17})_{3n}$ as recited hereinabove.

The test procedures make use of a LaunderOmeter (Manufactured by Atlas Electric Devices Co., Chicago, Ill.). Test swatches, weighing approximately 5 grams per set and each about 2¼" by 2¼" are agitated for 15 minutes in 200 ml of wash cycle test solution at 120° F. Each LaunderOmeter jar, 1 pint total capacity, contains one set of swatches and 20¼" stainless steel balls. The swatches in each set are stapled together in pairs so that the two swatches overlap by about ¼". The swatch pairs are separated with No. 2 rubber stoppers, with the ends slit, such that each stopper contains a maximum of two swatch pairs. After washing, the swatches are removed from the solution, spun in a centrifuge for 5 seconds at 2000 rpm, and then, still separated by stoppers, are agitated for 5 minutes in 200 ml of rinse cycle test solution, with 20 steel balls in each jar. After rinsing, the swatch pairs are removed from the solutions and from the stoppers, spun in the centrifuge, and then dried. The foregoing is a presoiling or preconditioning step prior to the actual soil, wash, rinse and dry cycles described in the following.

All the dried sets of swatches are combined, and then soiled with dilute soil which is obtained by diluting 400 grams of a modified Spangler soil with 100 ml deionized water. A volume of dilute soil should be used such that there are 50 ml per each swatch set. The undried, soiled swatches are then reattached to the rubber stoppers. The swatch sets are washed and rinsed in the proper test solutions according to the above procedure and finally dried.

In examples 1 through 5 below, both the treated fabric and the control fabric are white 100% polyester doubleknit and the soil release polymer is TLF-3755 as hereinabove described.

EXAMPLE 1

A prepared rinse cycle product containing a cationic fabric softener and the soil release polymer was used in the rinse cycle at 0.20% concentration. The composition of the product is as follows:

| INGREDIENTS | % (By Weight) |
|---|---|
| Blended methyl difatty alkoxy ammonium sulfate and chloride quaternaries (Ashland Chemical, Varisoft 242PX) | 3.6 |
| Soil release polymer | 1.0 |
| Water, opacifier, perfume antifoam agent | q.s. |

The test results are as follows:

| | Reflectance, Rd units |
|---|---|
| Treated fabric after drying | 75.3 |
| Control fabric after drying | 71.2 |

EXAMPLE 2

A liquid laundry detergent containing the soil release polymer was used in the wash cycle at 0.10% concentration. The composition is as follows:

| INGREDIENTS | % (By Weight) |
|---|---|
| Nonylphenol with 9-10 moles ethylene oxide (GAF, Igepal CO-630) | 35 |
| Diethanolamine | 12 |
| Sodium linear dodecylbenzene sulfonate | 11 |
| Soil release polymer | 5 |
| Denatured alcohol | 4 |
| Water, perfume, dyes | q.s. |

The test results are as follows:

| | Reflectance, Rd units |
|---|---|
| Treated Fabric after drying | 77.1 |
| Control fabric after drying | 73.8 |

EXAMPLE 3

A prepared solution consisting of the soil release polymer diluted with water for ease of use, was used at 0.20% concentration in the rinse cycle. The composition of this solution is as follows:

| INGREDIENT | % (By Weight) |
|---|---|
| Soil release polymer | 1.0 |
| Water, perfume, dye | q.s. |

The results of the test are as follows:

| | Reflectance, Rd units |
|---|---|
| Treated Fabric after drying | 74.1 |
| Control fabric after drying | 69.7 |

EXAMPLE 4

A prepared powdered laundry detergent product containing the soil release polymer was used at 0.15% concentration in the wash cycle. The composition of the product is as follows:

| INGREDIENT | % (By Weight) |
|---|---|
| Sodium linear dodecylbenzene sulfonate | 15.0 |
| Sodium carbonate | 35.0 |
| Sodium silicate (1:2.4 $Na_2O:SiO_2$) | 15.0 |
| Carboxymethyl cellulose | 2.0 |
| Soil release polymer | 6.7 |
| Sodium sulfate, fluorescent whitening agent, perfume, dye, water | q.s. |

Results of the test are as follows:

| | Reflectance, Rd units |
|---|---|
| Treated Fabric after drying | 65.3 |
| Control fabric after drying | 64.4 |

EXAMPLE 5

A prepared liquid laundry starch composition containing the soil release polymer was used by applying a 1 to 16 dilution of the composition to the fabric at the end of the initial laundry cycle and prior to drying. Forty milliliters of the dilute starch was used in the test. Composition of the prepared starch is as follows:

| INGREDIENT | % (By Weight) |
|---|---|
| Corn starch | 6.76 |
| Sodium Chloride | 6.76 |
| Soil release polymer | 1.00 |
| Waste, ironing ease agent, emulsifier, bacteriostats, dye, perfurme. | q.s. |

The results of the test are as follows:

| | Reflectance, Rd units |
|---|---|
| Treated fabric after drying | 83.2 |
| Control fabric after drying | 74.1 |

The values shown above for "Rd" units were determined by measurement of degrees of whiteness using a conventional Photovolt Reflectometer (Photovolt Model 610 Reflection meter manufactured by Photovolt Corporation) using a green filter.

The soil release polymer TLF 3755 used in Examples 1 through 5 above is operative on blends of any of the synthetic fabrics we have named with other unnamed synthetic fibers, e.g. acrylic, rayon acetate, triacetate and others. The soil release agent is also workable on blends of the named synthetics with natural fibers such as cotton, silk and wool.

The following tabulation is given of further test results on synthetic fibers and blends thereof using the same polymer product, the fabrics in each instance having been laundered according to the procedures explained with reference to Examples 1 through 5 except that the control solution was water. The product used was that of Example 1.

| Fiber or Fiber Blend | Reflectance, Rd units, after 5 cycles: Treated Fabric after drying | Control Fabric after drying |
|---|---|---|
| Polyamide | 73.2 | 68.4 |
| Polyamide/spandex blend (69/31) | 64.9 | 60.5 |
| Polyester (doubleknit) | 79.7 | 60.4 |
| Polyester/cotton blend (65/35) | 73.2 | 64.9 |
| Modacrylic | 63.4 | 45.3 |
| Rayon | 75.5 | 72.0 |

We claim:

1. The method of imparting soil release properties to fabrics consisting of polyester, polyamide, rayon or modacrylic fibers and blends of these fibers with other natural or synthetic fibers during a home laundering process, which consists essentially of the following steps and conditions: agitating said fabrics in an aqueous dispersion of the soil release polymer product which has an empirical formula of $(C_{39}H_{79}N_2O_{17})_{3n}$, where n is equal to about 3–10, at a polymer concentration of about 0.0002 to 0.2 weight percent of the water and subsequently drying the fabrics at a temperature customarily employed in home laundering, said soil release polymer being characterized as having been prepared by:

(a) loading into a clean and dried reactor, 209 parts of a mixture comprising 18% ethylene glycol and 82% of

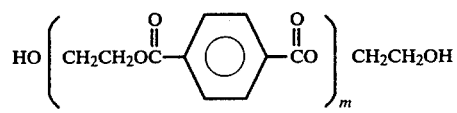

where m is equal to 1–3, to obtain an oligomer mixture with a melting point between 160° and 185° C.;

(b) adding to said oligomer mixture 1298 parts of the monomethylether of polyethylene glycol of molecular weight about 550, and about 789 parts of a product prepared by ethoxylation of the mixture of straight-chain alcohols containing 60% dodecanol, 25% tetradecanol and 11% hexadecanol to form a product containing 15 links of ethylene oxide for every mole of alcohol;

(c) heating the resulting mixture to 210°±2° C., maintaining this temperature for one half hour and then cooling and maintaining the mixture at a temperature of 135°±5° C.;

(d) adding 357 parts of hexa(methoxymethyl) melamine and reducing the pressure on the mixture to 20–40 torr for one half hour;

(e) introducing gaseous nitrogen to adjust the pressure of the reactor to one atmosphere and adding 3.17 parts of anhydrous p-toluene sulfonic acid before reducing the pressure to 200 torr;

(f) reducing the pressure in the reactor after the reaction has started to between 20 and 40 torr, and heating the load in the reactor to 190°±2° C., and maintaining this temperature for four hours to terminate the reaction;

(g) cooling the load in the reactor to about 70° C. and bringing the pressure in the reactor to atmospheric pressure by adding nitrogen;

(h) adding the reacted load of step (g) to a preformed mixture of 9972 parts of water and 1.7 parts of sodium bicarbonate to form an aqueous dispersion of about 20% concentration of the said soil release polymer which has an empirical formula of $(C_{39}H_{79}N_2O_{17})_{3n}$, said dispersion upon dilution being suitable for the treatment of textiles to improve their antistaining properties.

2. The method of claim 2 in which said polymer is added to the wash cycle in a home laundering machine.

3. The method of claim 2 in which said polymer is added to the rinse cycle in a home laundering machine.

4. The method of claim 2 in which n has a value of about 3.3 to 4.0 and said concentration is in the range of about 0.001 to 0.01 percent.

5. The method of claim 2 in which the release polymer is added to the laundry water as a relatively concentrated aqueous solution of the polymer.

6. The process of claim 6 in which the said solution contains a fabric softener of the composition of blended methyl difatty alkoxy ammonium sulfate and chloride quaternaries.

* * * * *